US005939683A

United States Patent [19]

Hoskins et al.

[11] Patent Number: 5,939,683

[45] Date of Patent: Aug. 17, 1999

[54] HIGH/LOW BEAM HEADLAMPS AND FOG LAMPS SWITCH ASSEMBLY

[75] Inventors: Steven R. Hoskins, Walled Lake; Sheldon J. Allen, Novi; Joseph E. Khoury, Farmington Hills, all of Mich.

[73] Assignee: Eaton Corporation, Cleveland, Ohio

[21] Appl. No.: 09/016,695

[22] Filed: Jan. 30, 1998

[51] Int. Cl.[6] ..... H01H 9/00; H01H 3/16

[52] U.S. Cl. ..... 200/5 R; 200/4; 200/18; 200/61.27

[58] Field of Search ..... 200/5 R, 4, 315, 200/61.27–61.38, 61.54, 553–563, 18

[56] References Cited

U.S. PATENT DOCUMENTS

| | | | |
|---|---|---|---|
| 3,691,323 | 9/1972 | Anderson et al. | 200/4 |
| 4,315,117 | 2/1982 | Kokubu et al. | 200/5 R X |
| 4,866,221 | 9/1989 | Obermann et al. | 200/5 R |
| 4,891,475 | 1/1990 | Wiersing et al. | 200/5 R |
| 4,920,239 | 4/1990 | Buhler et al. | 200/61.54 |
| 4,929,806 | 5/1990 | Furuhashi et al. | 200/61.54 |
| 5,049,706 | 9/1991 | Du Rocher | 200/61.54 |
| 5,272,290 | 12/1993 | Suzuki et al. | 200/4 |
| 5,336,859 | 8/1994 | Wojtanek et al. | 200/315 |
| 5,804,782 | 9/1998 | Newman et al. | 200/61.27 |

*Primary Examiner*—J. R. Scott
*Attorney, Agent, or Firm*—Roger A. Johnston

[57] ABSTRACT

A switch assembly having a sliding actuator adapted to be moved by a cam on a stalk lever. Initial movement of the actuator from a neutral position by user movement of the lever moves a first contact carried by the actuator to break a connection between a power bus and a fog lamp terminal strip in a planar array of strips. Further movement causes a second contact carried by the actuator to make a connection between another power bus strip and a high beam terminal strip. Continued movement of the sliding actuator causes rotational movement of a bi-stable rotor latched in one of its two bi-stable positions. Movement of the rotor causes a third contact on the rotor to shunt the second contact to make a second connection on another high beam strip and a fourth contact on the rotor breaks a second connection on the strip for the fog lamp electrically in series with the first connection. Subsequent return of the sliding actuator to its beginning or neutral position by user release of the lever does not effect the position of the third and fourth contacts, as the rotor is latched. A subsequent actuation of the stalk lever by the user again moves the sliding actuator to effect movement of the bi-stable member in the opposite direction to disconnect the high beam headlamps and reconnect the low beam and fog lamps, and the bi-stable member is again latched in the position with the low beams headlamps on.

11 Claims, 9 Drawing Sheets

LO BEAM
HI BEAM
FOG LAMP
B+
R

0° LEVER PULL

2° LEVER PULL

4° LEVER PULL

6° LEVER PULL 7.3° LEVER PULL

HIGH/LOW BEAM HEADLAMPS AND FOG LAMPS SWITCH ASSEMBLY

BACKGROUND OF THE INVENTION

The present invention relates to switching devices for controlling vehicle headlamps and fog lamps. Heretofore, switches employed for controlling high and low beam headlamps and providing a flash-to-pass function and also incorporating the switching function for the fog lamps have been actuated by a stalk or lever mounted on the steering column. Typically, movement of the stalk or lever in the direction coinciding with the axis of the steering column has been employed for changing the headlamp from the low beam to the high beam mode and simultaneously switching off the fog lamps in the event same were on at the time of the user actuating the stalk. Heretofore, the switching contacts employed for effecting the switching functions were of relatively low current carrying capacity in order to render the switch compact and inexpensive; and, consequently, the switching contacts were only used to energize relays for switching the current for the headlamps and fog lamps.

Referring to FIG. 11, a schematic for a prior art flash-to-pass headlamp switching system is illustrated in which a stalk operated switch assembly 1 is connected to the vehicle power supply at terminal 2 which is connected through junction 3 to the common terminal 4 of a single pole double throw (SPDT) switch having a side contact 5 which is connected through connector terminal 6 to a low beam headlamp. The opposite side contact 7 of the SPDT switch is connected through connector terminal 8 to an input terminal 9 of a relay 10. Side contact 7 is also connected to a side contact 11 of a single pole single throw switch having user moveable actuator 12 for, upon closing of the switch, connecting side terminal 11 to an opposite side terminal 13 which is connected to the power junction 3.

The input terminal 9 of relay 10 is connected to one lead of a relay coil 14 which has the opposite lead connected through terminal 15 to ground. A resistor R is provided in parallel with the coil. A power input terminal 16 is connected to the vehicle power supply and to the common terminal 17 of a second single pole double throw switch having one side contact 18 thereof connected through an output terminal 19 to a vehicle fog lamp. A second side contact 20 is disposed opposite the switch contact 18 and is connected through connector terminal 21 the vehicle high beam lamp. Thus, user movement of switch actuator 12, which may be effected by a steering column mounted stalk lever, also causes switch member 4 to break the power to the low beam headlamp and apply power to the high beam input of the relay 10; and, simultaneously the switch actuator 4 is latched to secure power to the high beam input to the relay. Energization of relay coil 14 causes switch member 17 to break the current to the fog lamps and switch power to the high beam headlamp.

It has been desired to maintain the simple single stroke lever actuation of the steering column mounted stalk lever for performing the high beam switching and flash-to-pass function; and, thus limited switching motion is available to perform the various switching functions required for flash-to-pass operation.

In the high-volume, mass-production of motor vehicles, it has been desired to minimize the cost of electrical switching functions and thus it has been desired to find a way or means of eliminating the relays required for the high beam and flash-to-pass switching functions of the headlamps and fog lamps and direct switching of the head lamp current yet retain the use of the steering column mounted stalk lever for user actuation of the flash-to-pass function.

BRIEF SUMMARY OF THE INVENTION

The present invention provides a reliable and robust switching assembly for switching on and off the high beam headlamps and switching off the fog lamps, if on, prior to energizing the high beam headlamps in order to minimize the current flow in the switch members and contacts.

The present invention performs the aforesaid switching operations, including flash-to-pass mode switching with a bi-stable rotary switch responsive to successive movement of a sliding shorting bar switch which is actuated in a push-push mode typically by the user movement of a steering column mounted stalk lever.

A user pull on the stalk lever effects push movement of the shorting bar which initially breaks contact with a power bus strip and a terminal strip connected to the fog lamps; and, subsequently as the stroke of the sliding bar continues, a powered bus strip is connected to a terminal strip wired to the high beam headlamps.

As the stalk lever push actuator stroke continues the bi-stable switch is rotated to connect the powered bus strip to the high beam contact strip by a different path thereby shunting the sliding actuator contact. The bi-stable rotary switch also breaks a separate connection in the current path between the powered terminal bus strip and the fog lamps to prevent re-energization of the fog lamps and similarly breaks a connection in the low beam circuit. The bi-stable rotary switch is latched in the actuated position; and, upon release of the sliding actuator to return to the neutral position, the high beam headlamps are maintained energized by the rotary switch and the fog lamp and low beams are maintained as de-energized. A second or subsequent actuation of the stalk lever by the user effects movement again of sliding contact in the push mode and reverses the movement of the bi-stable rotary switch and de-energizes the low beam headlamps, fog lamps and de-energizes the high beam in reverse sequence. The rotary switch is latched in the second position until the subsequent push movement of the sliding actuator.

The present invention thus provides a unique stalk lever operated push—push actuated switch assembly which provides a sequential deactivation of fog lamps, actuation of high beams and deactuation of low beams by direct action of sliding contacts on a planar array of terminal strips capable of handling the various headlamp currents directly and thus eliminates the need for relays and results in a lower cost yet robust and reliable switching arrangement.

BRIEF DESCRIPTION OF THE DRAWINGS

FIG. 11 is a circuit schematic of a prior art relay energized headlamp switching system;

FIG. 12 is a circuit schematic of the switching arrangement of the present invention;

DETAILED DESCRIPTION OF THE INVENTION

Figure 1:
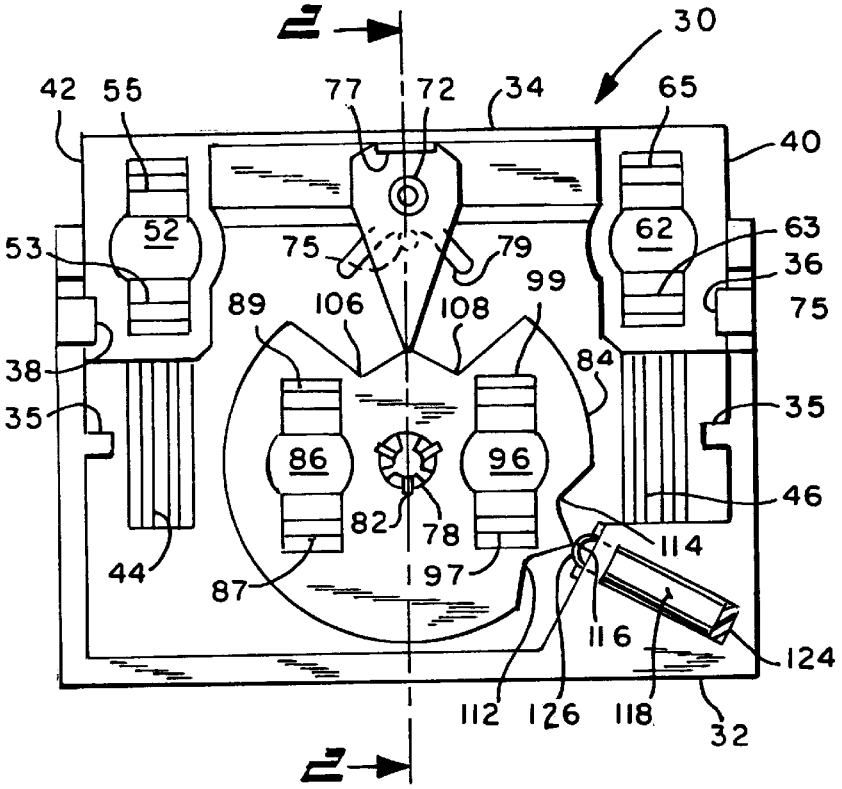
FIG. 1 is a plan view of the switch assembly of the present invention with the terminal strip cover removed showing the internal components.
Figure 2:
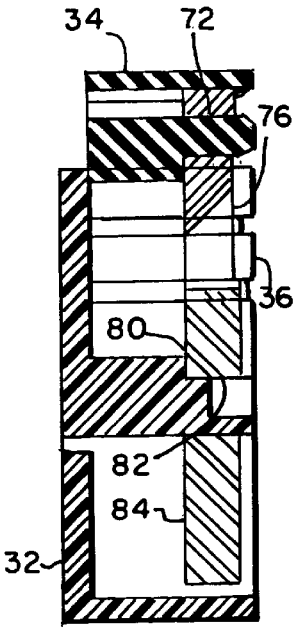
FIG. 2 is a section view taken along section indicating lines 2—2 of FIG. 1.
Figure 3:
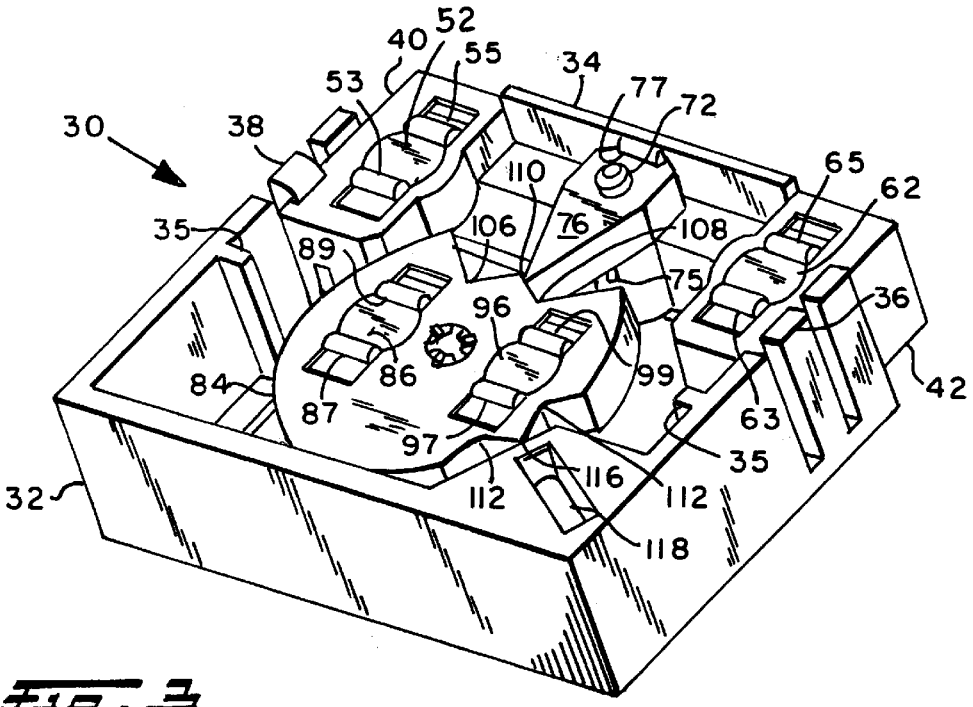
FIG. 3 is an axonometric view of the assembly of FIG. 1.
Figure 4:
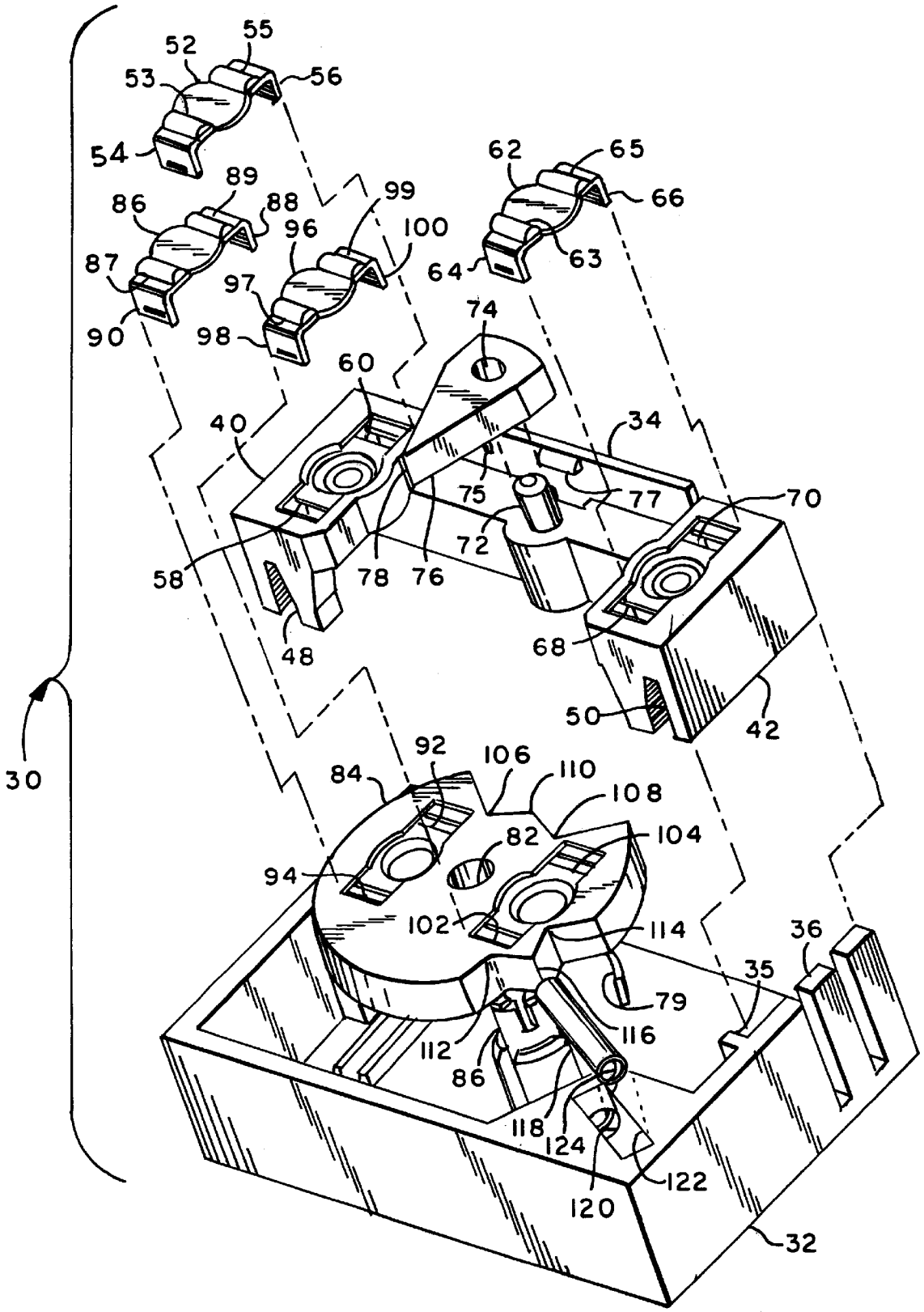
FIG. 4 is an exploded view of the assembly of FIG. 3.

Referring to FIGS. 1 through 4, the switch assembly of the present invention is indicated generally at 30 and includes a base or housing 32 having a push-type actuator 34 or Beam Select plunger slidably received therein and retained by snap tabs 36, 38. The sliding actuator 34 has a generally U-shaped configuration in plan view and has the oppositely disposed parallel legs 40, 42 thereof slidably guided by ribs or ways 44, 46 formed in the housing 32 which respectively engage grooves 48, 50 formed in the legs 40, 42 of the actuator 34 for guiding the sliding movement thereof A pair of stops 35 formed on the sides of housing 32 serve to limit the stroke of actuator 34.

The sliding actuator 34 has an electrically conductive contact member 52 mounted on the upper surface thereof by flanges 54, 56 provided on the ends thereof and which flanges are received in grooves 58, 60 respectively formed in the upper surface of the leg 40. A second contact member 62 similarly has a pair of downwardly extending end flanges 64, 66 which are received respectively in grooves 68, 70 formed in the upper surface of leg 42 of actuator 34. Contact 52 has a pair of spaced, raised, preferably cylindrical, contact surfaces 53, 55 provided thereon; and, contact 62 also has a pair of spaced, raised, preferably cylindrical contact surfaces 63, 65 provided thereon.

Actuator 34 has a centrally disposed upstanding post or projection 72 provided thereon which is rotatably received in a bore 74 provided in a flipper 76 which is rotatably mounted on the post 72. Flipper 76 has a wedge or chiseled contact surface 78 formed on the end thereof which is intended for contacting an associated member as will hereinafter be described.

Flipper 76 is biased to the center by a spring finger member 77 formed integrally with actuator 34. Clockwise and counterclockwise rotation of flipper 76 about post 72 is limited by a curved track 79 formed in the base of housing 32 which track is engaged by a downwardly extending pin 75 formed on the undesirable of flipper 76.

Housing 32 also has an upstanding post or projection 80 formed thereon which is received in a bore 82 provided in a rotary switch member 84 which is thus rotatably received over the post 80.

Switch member 84 has disposed, in diametrally oppositely spaced arrangement, a third contact member 86 having a pair of downwardly extending end flanges 88, 90 formed thereon which are respectively received in grooves 92, 94 formed in the upper surface of switch member 84. A fourth contact member 96 is disposed on the opposite side of bore 82 from contact 86 in generally spaced parallel arrangement therewith, the contact 96 having also a downwardly extending pair of end flanges 98, 100 which are respectively received in grooves 102, 104 formed in the upper surface of switch member 84.

The rotary switch member 84 has a bi-stable camming surface formed in the periphery thereof which comprises a pair of V-shaped notches 106, 108 formed on opposite sides of an apex 110 which is disposed equidistant from grooves 92, 104.

The rotary switch member 84 also has a pair of recesses 112, 114 formed on the periphery thereof and angularly displaced circumferentially from the notches 106, 108 with the recesses forming a common apex 116 therebetween to thus form a pair of detent surfaces.

A plunger 118 is slidably received in an aperture 120 formed in a recess 122 provided in the housing; and, the plunger 118 is biased outwardly of the recess by a spring 124. The plunger 118 has a generally spherical end 126 which is in contact with the detent surfaces 112, 114. It will be understood that the arrangement of the plunger and detent surfaces is such that the rotary switch member 84 is latched into either a position where the plunger end 126 engages recess 114, in which position the rotary switching member 84 will be rotated slightly clockwise from the position shown in FIGS. 1, 3 and 4, or to a position where the member 84 is rotated counterclockwise slightly from the position shown in FIGS. 1, 3 and 4. It will be apparent from the drawings that the orientation of the apex 78 and the apex 116 coincide respectively with the center position of the flipper 76 and the plunger end 126.

Referring to FIGS. 5 through 10, 12 through 17 and Table I, the switching operation of the actuator 34 and the rotary switching member 84 are shown in dashed outline in FIGS. 5 through 8 and in solid outline in FIGS. 13 through 17 in their various operating positions as will be further described in detail.

Referring to FIGS. 5 through 8, the pattern for the switching terminal strips which are provided on the undersurface of an unshown cover for housing 32 is illustrated schematically. A plurality of terminal strips, each disposed for wiping contact with one of the contacts 52, 62, 86, 96 respectively in a planar array and preferably on a common circuit board or part of a cover (not shown). A first strip 128 is disposed to have an upper portion 130 thereof arranged to be contacted by the wiper surfaces 55, 53 of the first contact member 52. Strip 128 has a lower distal portion 132 adapted for connection to a high beam headlamp; and, strip 128 has an intermediate switching portion 134 disposed for being switched by third switching contact 86. A second contact strip 136 is disposed in generally spaced parallel relationship with strip 128 and has an upper portion 137 disposed for being switched by contact member 52 which in association with upper portion 130 of the first strip forms a first switch indicated generally at 138 which is of single pole single throw (SPST) type. Strip 136 has the lower distal end thereof adapted for connection to an on-board source of power as indicated by the B+character in FIGS. 5 through 8 and 12.

A third terminal strip 140 is disposed in spaced parallel relationship with strip 136 and has the upper portion thereof disposed for switching contact with third contact member 86, which in cooperation with strips 136 and 134 comprises a single pole double throw (SPDT) switch indicated generally with reference numeral 141. The lower distal end 142 of strip 140 is adapted for connection to the low beam headlamps.

A fourth terminal strip 144 is disposed in spaced parallel relationship with the distal end 142 of strip 140 and is adapted for connection to the vehicle fog lamps. Strip 144 has the upper end 146 thereof disposed adjacent a fifth terminal strip 148 which in association with fourth contact member 96, comprises a third switch indicated generally at 150 which is of the SPST type. The fifth terminal strip 148 has an upper end portion 152 disposed for being contacted by second contact member 62; and, strip 148 is also disposed adjacent a sixth terminal strip 154 disposed in spaced parallel relationship from the strip 148, with the lower or distal end of strip 154 adapted for connection to a vehicle power supply denoted by reference character B+. The second contact member 62, in association with the strip portion 152 and the upper end 156 of strip 154, functions as a fourth switch of the single pole single throw (SPST) type indicated generally at 158.

Figure 5:
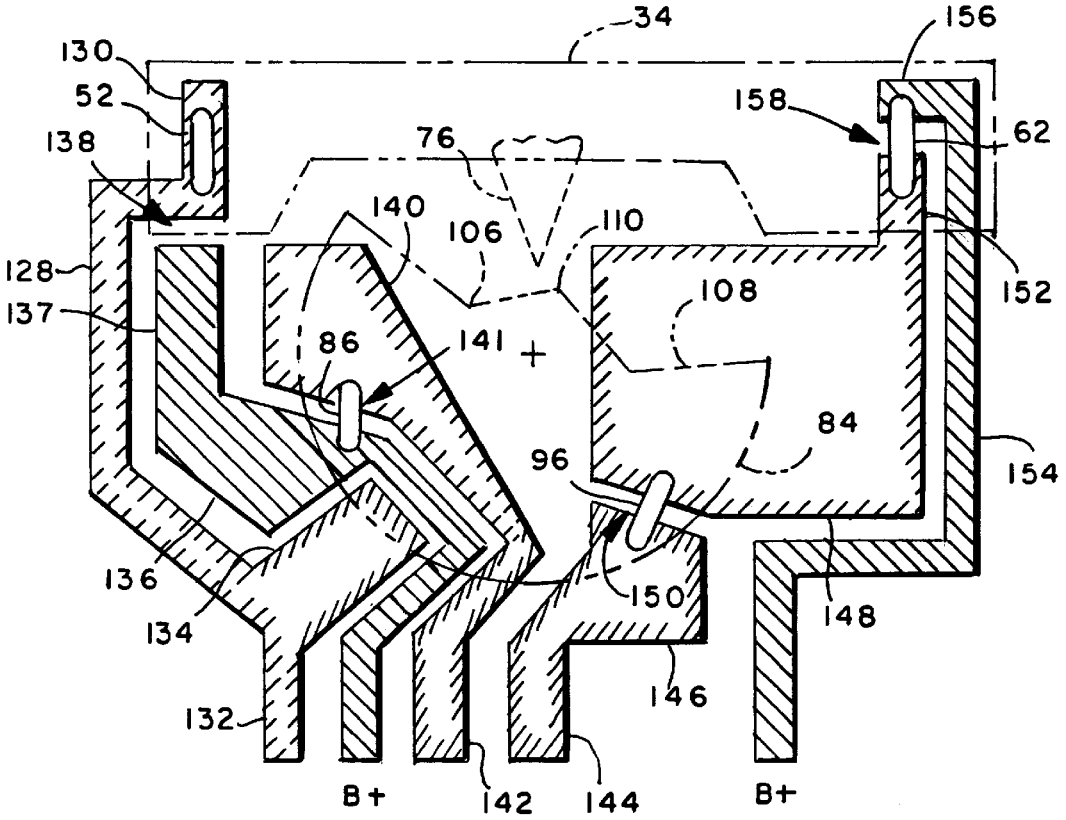
FIG. 5 is a schematic of the switching arrangement of the terminal strips showing the push actuator in the neutral position with the low beam headlamps and fog lamps energized.

Referring to FIG. 12, the relationship of the switch contact members and contact strips described with respect to FIG. 5 is indicated in FIG. 12 wherein the B+power inputs are indicated at the input terminals as connected to strip 136 for the high beam headlamps and contact strip 154 for the fog lamps. The single pole double throw (SPDT) switch 141 is indicated schematically as having side contacts connected respectively to strips 132 for the high beam and 142 for the low beam.

The single pole single throw switch 150 is indicated electrically in series with switch 158 and as having one side thereof connected through strip 144 to the fog lamps with the opposite side connected through the upper portion 152 of strip 148 to one side of switch 158. The opposite side of switch 158 is connected, through strip 154 by movement of second contact 62, to the vehicle power supply. Switch 138 has one side thereof connected through strip 137 to the vehicle power supply; and, the opposite side of switch 138 is connected through contact strip 128 to the high beam lamps by the movement of first contact member 52.

Referring to FIGS. 5 through 10, 12 through 18, the operation of the switch assembly of the present invention will be described wherein the sliding actuator member 34 is moved by a cam 160 rotatable about trunnions 162, 164 which are suitably journalled on the vehicle steering column (not shown); and, the cam is rotated by a block 166 which has attached thereto a stalk lever 168 adapted for user movement thereof to cause rotation of the lever about an axis passing through trunnions 162, 164. Cam 160 is operative to rotate against the outside edge of sliding actuator 34 to effect movement thereof. In the present practice of the invention the cam is profiled to give a sliding stroke to actuator 34 as set forth in Table I below with actuator 34 having a full stroke of about 6.0 millimeters.

TABLE I

| Stalk Lever Rotation | Percent (%) Stroke of Actuator 34 |
|---|---|
| 0° | 0 |
| 2° | 27 |
| 4° | 54.7 |
| 6° | 82.2 |
| 7.3° | 100 |

However, it will be understood that other cam profiles may be employed; and, the amount of stroke of actuator 34 may vary in accordance with the desired sequence of switching. It will also be understood that the configuration and arrangement of the first through sixth terminal strips may be varied to provide a different sequence of switching from that described in FIGS. 9 and 10 within the purview of the invention.

Referring to FIG. 5 and Table I, the sliding actuator 34 is shown in the neutral or at-rest upward position to which it is biased by a suitable spring mechanism (not shown) which may be by any convenient manner well known in the art and which has been omitted from the drawings for simplicity of illustration. The position of the actuator 34 shown in FIG. 5 corresponds to the arrangement of FIG. 13 in which the rotor 84 is latched in its clockwise position by engagement of the end 126 of plunger 118 in detent recess 114. It will be seen from FIGS. 5 and 13 that in the neutral or upward position of actuator 34, the flipper 76 does not engage the cam surface of the rotary switching member 84. It will be understood that the stalk lever 168 is in the 0° lever pull position as defined in the table of Table I.

With the actuator 34 in the upward or neutral position shown in FIG. 5, 9, 10 and 13, the switch 158 is closed and switch 150 is closed by the rotary switching member 84 thereby energizing the fog lamps. The low beam headlamps are energized through switch 141 with switch 138 being open.

Figure 6:
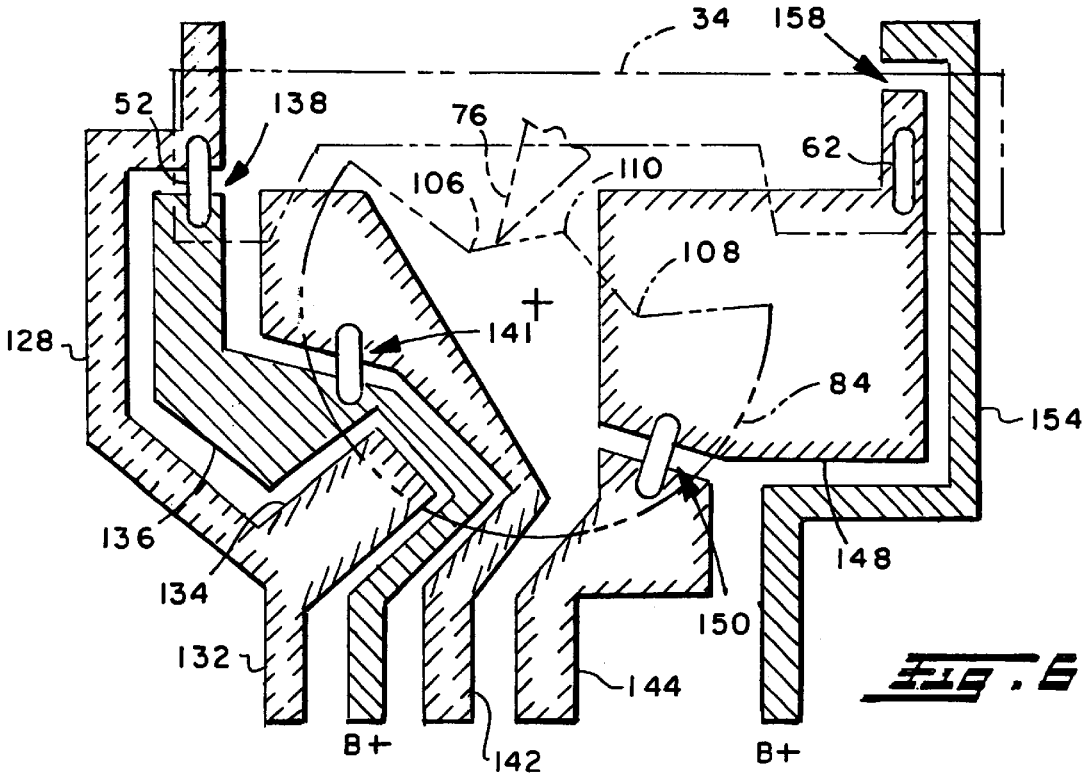
FIG. 6 is a view similar to FIG. 5 showing the sliding actuator of FIG. 5 partially actuated prior to actuation of the bi-stable rotary switch with the high beam headlamps energized and the fog lamps de-energized.
Figure 14:
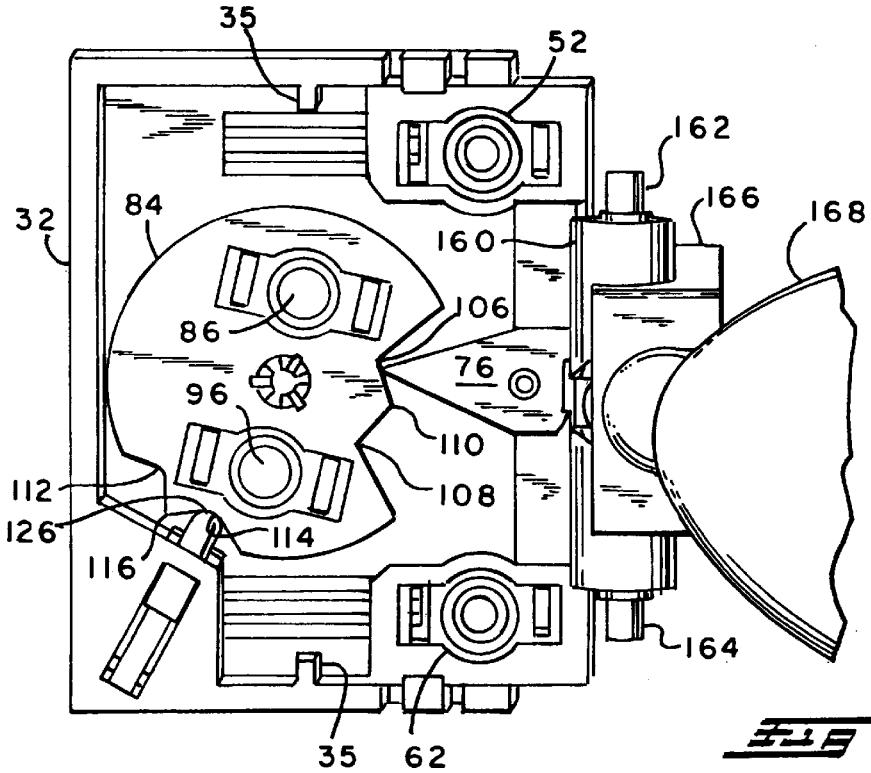
FIG. 14 is a view similar to FIG. 13 with the actuating stalk lever pulled for 2° notation about the pivot.

Referring to FIGS. 6, 9, 10, 14 and Table I, the user has moved the actuator lever 168 by an amount to cause rotation of 2° about the axis of trunnions 162, 164 and the profile of cam 160 has caused the actuator 34 to move to the position shown in FIGS. 6 and 14, wherein flipper 76 has engaged the side of slot 106 to move partially therealong. The actuator 34 has caused second contact 62 to open switch 158 and has caused first contact 52 to close switch 138. The sequence of events is illustrated with reference to FIG. 9 and Table I wherein at 2° of stalk lever rotation the actuator 34 has moved an amount corresponding to 27% of its full stroke. However, as the actuator passed through approximately 16% of its stroke, switch 158 opened and at approximately 19% of its stroke switch 138 closed to energize the high beam lamps.

Figure 15:
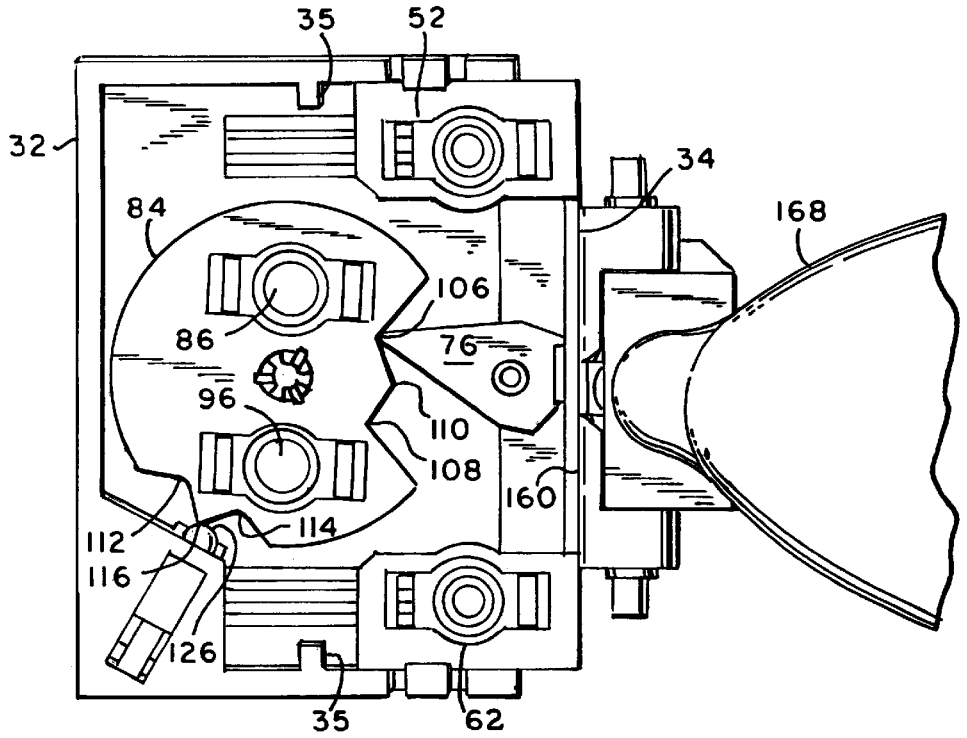
FIG. 15 is a view similar to FIG. 13 with the actuating stalk lever pulled for 4° rotation about the pivot.

Referring to FIGS. 7, 9, 10, 15 and Table I, the stalk lever 168 has been moved by the user to a position corresponding to 4° of rotation whereby the profile of cam 160 has caused actuator 34 to move about 54.7% of its full stroke. In this latter position of the actuator 34, the flipper 76 has engaged the bottom of notch 106 on rotor 84 and has caused the rotor to rotate slightly in a counter-clockwise direction to cause the end 126 of plunger 118 to ramp up the side of recess 114 to the apex 116 of the detent as shown in FIG. 15. In this latter position of the actuator 34, the rotor 84 is at the point of incipient instability; and, switch 141 has closed the connection between contact strips 134 and contact strip 137 and has opened the connection between contact strip 142 and contact strip 137 thereby de-energizing the low beam headlamps. Switch 150 has opened to break a second connection in the circuit for the fog lamps.

Figure 9:
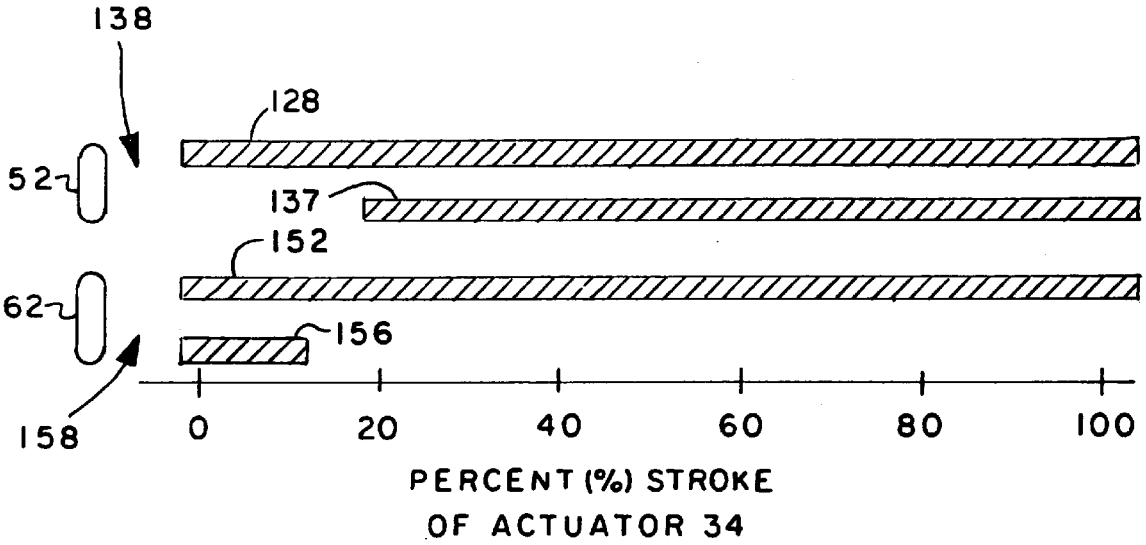
FIG. 9 is a sequence diagram of the actuation of the contacts by the sliding actuator.
Figure 10:
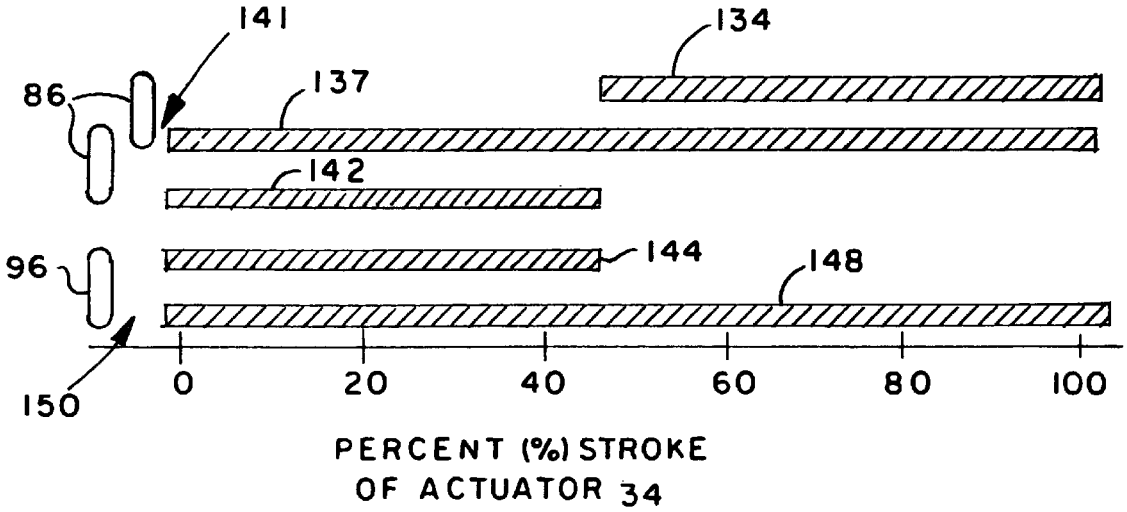
FIG. 10 is a sequence diagram of the contact actuation of the bi-stable rotary switch.
Figures 5A, 5B:
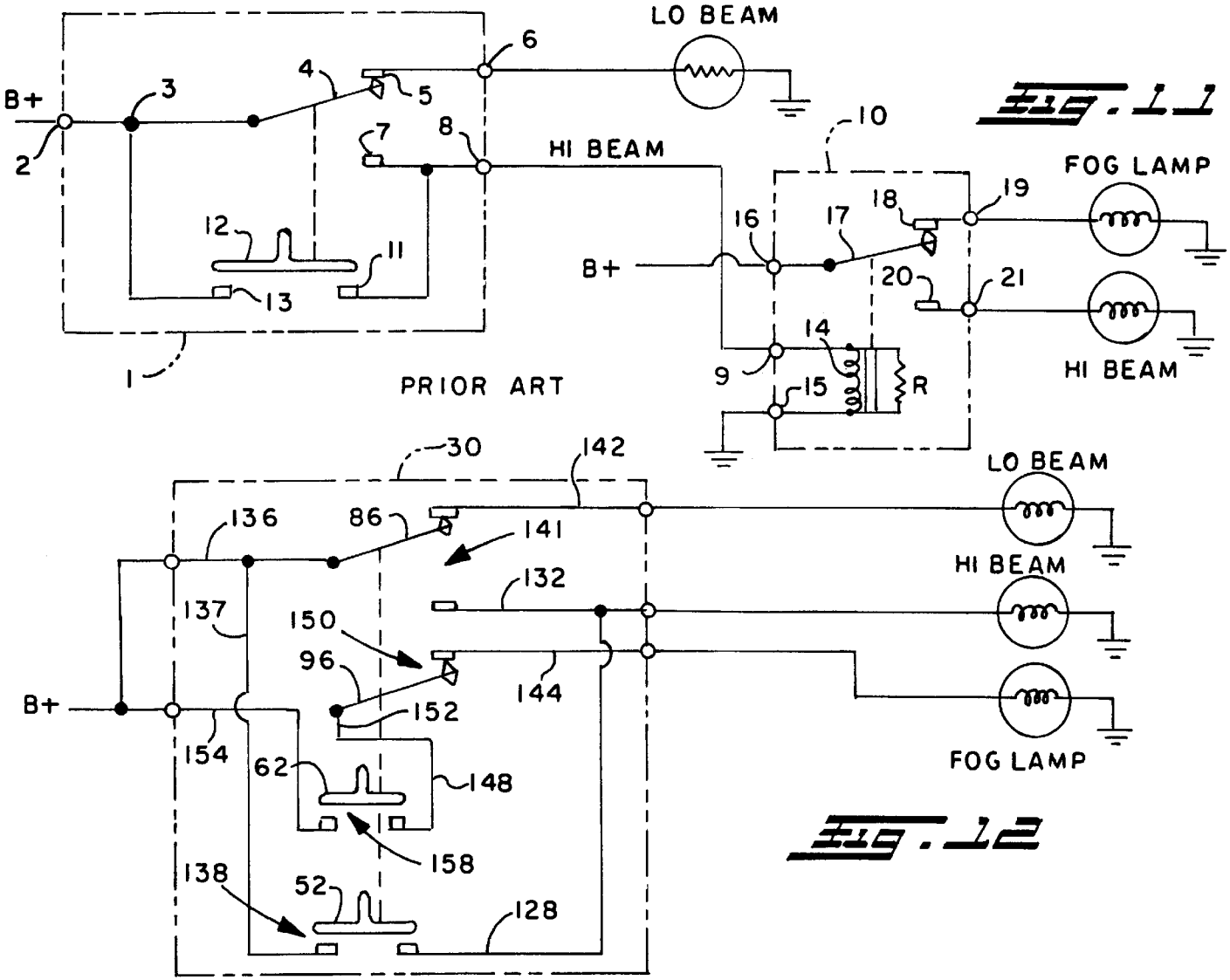
FIG. 5B PRIOR ART
Figure 13:
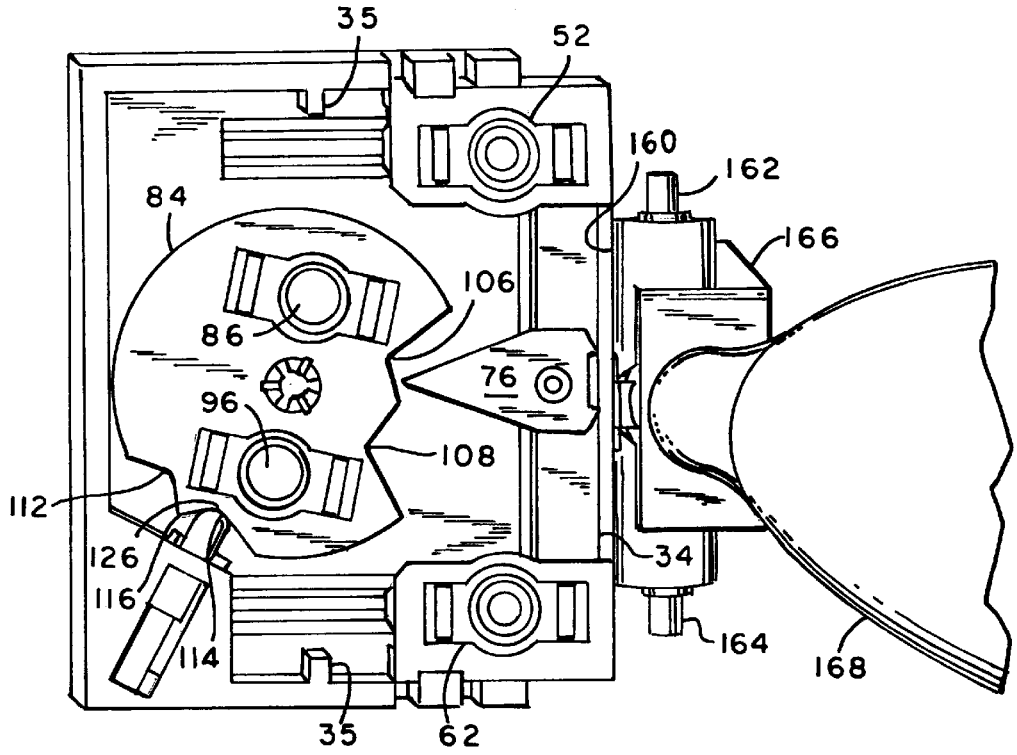
FIG. 13 is a plan view of the switch assembly of the present invention with the actuating stalk lever in the zero or neutral position.
Figure 16:
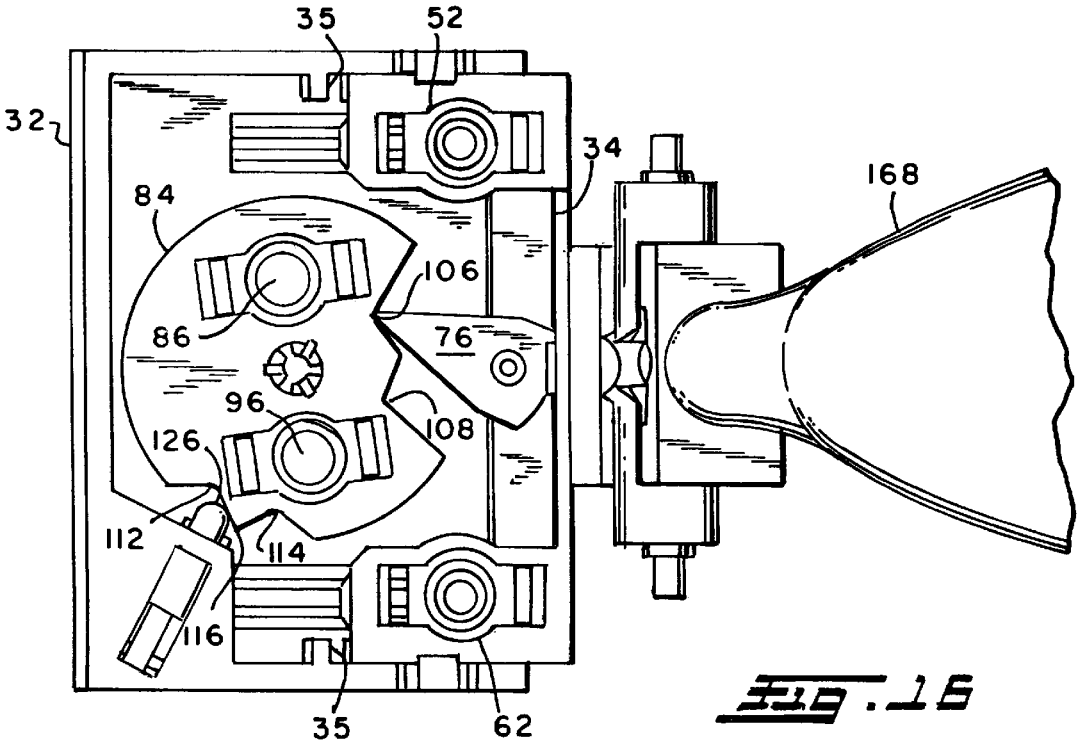
FIG. 16 is a view similar to FIG. 13 with the actuating stalk lever pulled for 6° rotation about the pivot; and, FIG. 17 is a view similar to FIG. 13 with the actuating stalk lever pulled for about 7.3° rotation about the pivot.

Referring to FIGS. 7, 9, 10, 16 and Table I, the stalk lever 168 has been moved by the user an amount of 6° rotation about the trunnions; and, it will be seen from Table I this has caused cam profile 160 to effect movement which corresponds to about 82.2% of the full stroke of actuator 34. As shown in FIG. 16, this results in the flipper 76 engaging the bottom of cam notch 106 and move rotary switching member 84 in a counterclockwise direction to cause the detent apex 116 to move over the center of the end 126 of plunger 118 and ramp down the side of detent 112. With reference to FIGS. 9 and 10 it will be seen that this movement of apex 116 past the end 126 of plunger 118 causes no further switching of the electrical switches 138, 158, 141, 150, but results in latched rotational movement of rotary switching member 84.

Figure 17:
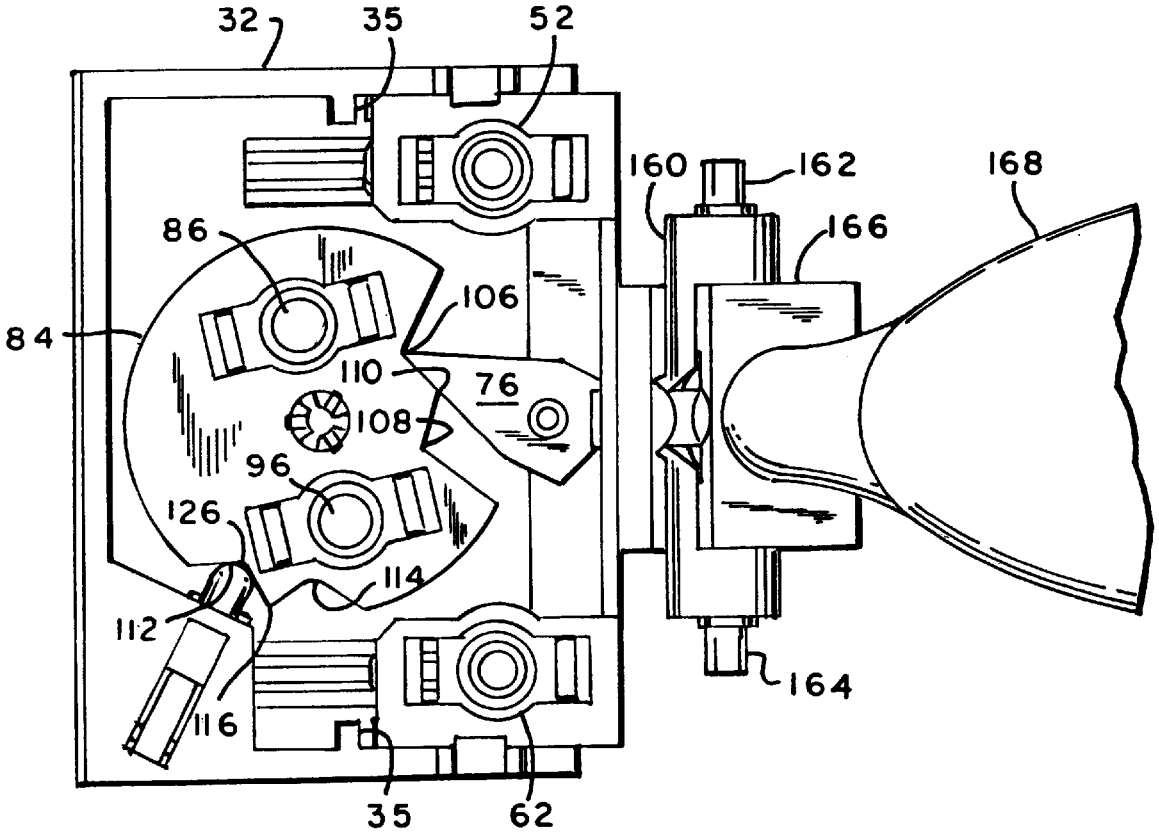

Referring to FIGS. 7, 9, 10, 17 and Table I, the stalk lever 168 is shown in the position in which the user has caused full rotation of about 7.3° of stalk lever 168 about the axis of the trunnions. In this position, as shown in FIG. 17, rotary switching member 84 has been moved by flipper 76 engaging the bottom of notch 106 to a position wherein the end 126 of plunger 118 engages the bottom of detent recess 112 and latches the rotor in the fully counterclockwise position.

Figure 7:
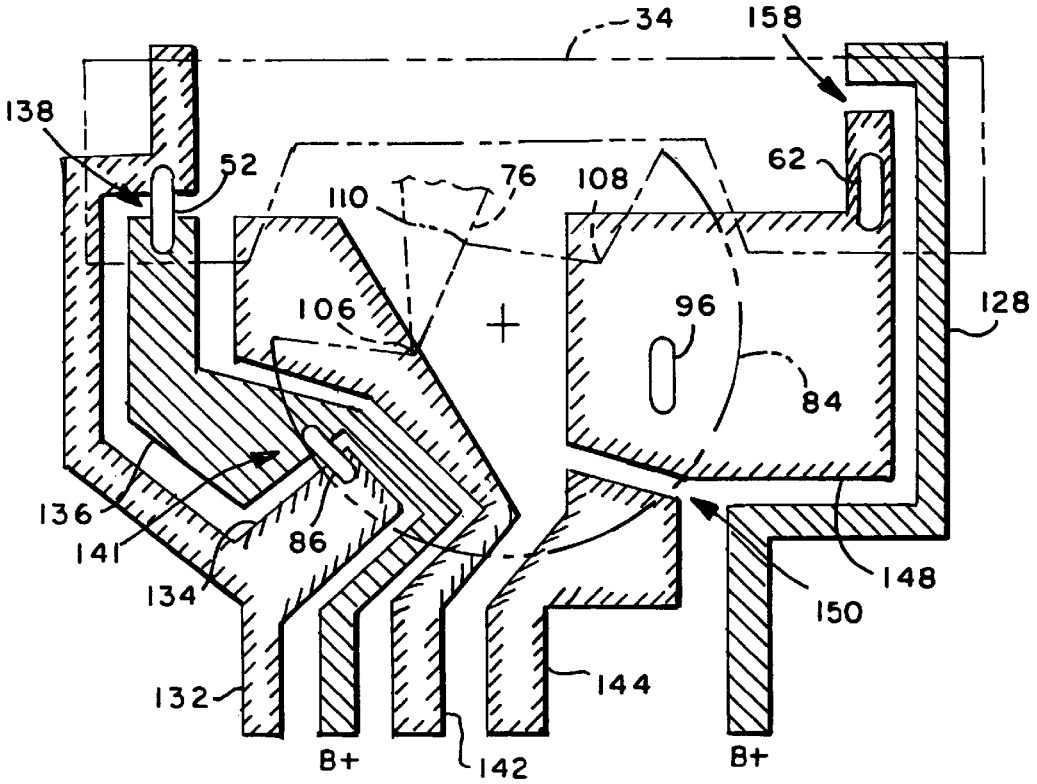
FIG. 7 is a view similar to FIG. 6 with the sliding actuator moved to its fully actuated position and the rotary switch actuated to provide a second break in the fog lamp circuit and a shunt path for energization of the high beam headlamps.

Referring to FIGS. 7, 9 and 10, rotary switching member 84 is shown with switch 141 having moved to a position causing the contact member 86 to provide connection between B+power strip 136 and strip 134 to provide a dual path or shunt of the power to the strip portion 130 connected to the high beam headlamps. In this position of the rotary switching member 84, switch 150 has opened to provide a second break in the fog lamp circuit. Thus, the high beam headlamps are latched on by rotary switching member 84 being detented by the end 126 of plunger 118.

Figure 8:
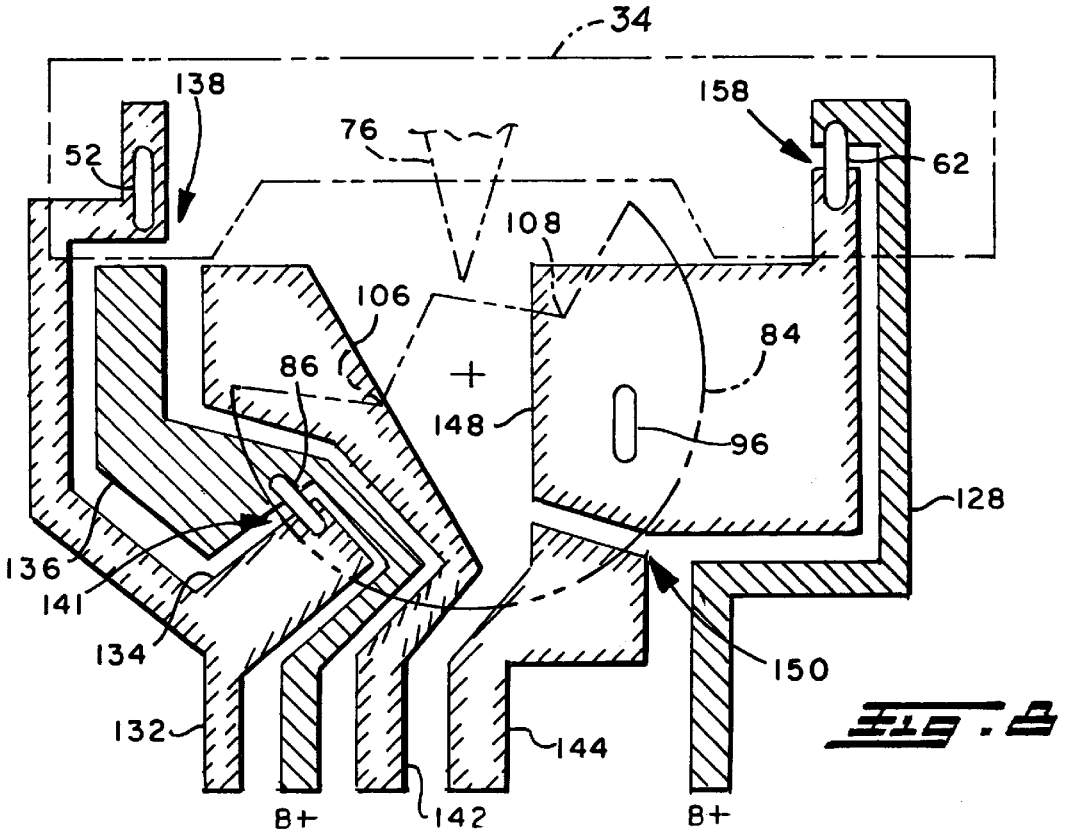
FIG. 8 is a view similar to FIG. 7 with the sliding actuator returned to the neutral position and the rotary switch latched in the position of FIG. 7.

Referring to FIGS. 8 through 10, the user has released the stalk lever to return the lever to the zero position whereby cam profile 160 has allowed the sliding actuator 34 to return to the neutral position as shown in FIG. 8. In the neutral position of the sliding actuator 34 as shown in FIG. 8, switch 138 is open and switch 158 has re-closed. However, rotary switching member 84 remains in the fully counterclockwise position as shown in FIG. 8, with switch 150 remaining open to prevent switch 158 from energizing the fog lamps; and, switch 141 remains in the position energizing the high beam headlamps. Thus the high beam headlamps are latched on. With reference to FIG. 8 it will be seen that flipper 76 has returned to the neutral position and remains in this position until a subsequent actuation of the lever 168 is effected by the user.

The present invention thus provides a unique, low cost, yet robust and simple to manufacture switching assembly for directly handling headlamp current to provide user control of the low beam and high beam headlamps and fog lamps and includes a flash-to-pass mode of function. The present invention thus permits such a switch to be employed for headlamp and fog lamp control without the necessity of relays.

Upon a subsequent user pull of lever 168, cam profile 160 causes actuator 34 to move downwardly from the position shown in FIG. 8, and flipper 76 engages the side of V-notch 108 causing sufficient movement of actuator 34, according to Table I, to cause rotary switching member 84 to move clockwise and return to the position shown in FIG. 5. Return of the rotor from the FIG. 8 to the FIG. 5 position de-energizes the high beam headlamps and re-energizes the low beam headlamp and fog lamps in reverse sequence.

Although the invention has hereinabove been described with respect to the illustrated embodiments, it will be understood that the invention is capable of modification and variation and is limited only by the following claims.

We claim:

1. A control switch assembly for selectively energizing high beam vehicle head lamps and comprising:

(a) a housing means having separate B+headlamp, high beam, low beam, B+fog, and fog lamp contact strips thereon including connector means adapting each of said strips for external circuit connection thereto;

(b) a plunger member disposed for sliding movement on said housing means between a neutral and a flash-to-pass position, said plunger means having a first and second shorting contact disposed thereon in spaced relationship;

(c) a carrier mounted for rotary movement on said housing means and having a third shorting contact disposed thereon on one side of the center of said rotary movement and a fourth shorting contact thereon disposed on the side opposite said one side of the center of said rotary movement, said carrier rotatable between a high beam and low beam position wherein said third contact is operative in said low beam position to connect said B+headlamp strip and said low beam strip, with said fourth shorting contact operative to connect said B+fog strip and said fog lamp strip, and in said high beam position said third contact is operative to connect said high beam strip and said B+headlamp strip and said fourth contact is operative to disconnect said B+fog strip from said fog lamp strip;

(d) bi-directional actuator means including a pawl member rotatably mounted on said plunger member and a camming surface on said carrier with said pawl member engaging said camming surface;

(e) said plunger, upon user effected movement from said neutral to said flash-to-pass portion, operative to sequentially first cause said second contact to break connection between said B+headlamp strip and said fog lamp strip and subsequently cause said first contact to connect said B+headlamp strip to said high beam strip; and, said pawl member is operative in cooperation with said camming surface to rotate said carrier from the last one of said high beam and low beam position to the other one of said high beam and low beam position;

(f) latching means associated with said plunger member and operative upon said sliding movement thereof to contact and releasably hold said carrier in at least one of said high beam and low beam position.

2. The switch assembly defined in claim 1, wherein said camming surface includes a bi-stable track which is operable upon contact by said pawl member to switch said carrier from the last of said high and low beam positions to the other of said positions with each successive movement of said plunger member.

3. The switch assembly defined in claim 1, wherein said strips are disposed in planar arrangement.

4. The switch assembly defined in claim 1, wherein said strips are disposed on a common circuit board.

5. A method of controlling high and low beam headlamps and fog lamps in a motor vehicle comprising:

(a) disposing a first and second single pole single throw (SPST) switch electrically in series with said fog lamps;

(b) disposing a third SPST switch electrically in series with said high beam lamps;

(c) disposing a fourth single pole double throw (SPDT) switch with one side of said third switch common thereto and connecting said low beam lamps and said high beam lamps respectively on opposite sides thereof;

(d) connecting said first and third switches to a first common actuator and connecting said second and fourth switches to a second common bi-stable actuator;

(e) moving said first common actuator and sequentially opening said first switch and closing said third switch; and, (f) moving said second common actuator from the last of one of a high beam and low beam position with each successive movement of said first common actuator to the other of said high and low beam position and sequentially opening said second switch and actuating said fourth switch to energize said high beam lamps in one of said positions of said second common bi-stable actuator and sequentially energizing said low beam lamps and closing said second switch in the other of said positions of said second common bi-stable actuator; and, (g) latching said second common bi-stable actuator in at least one of said high beam and low beam positions.

6. The method defined in claim 5, wherein said step of moving said second common bi-stable actuator includes mounting a contact of each of said second and fourth switches on a carrier and rotating said carrier.

7. The method defined in claim 5, wherein said step of connecting said first and third switches includes disposing a pair of contacts in spaced relationship on a plunger and sliding said contacts over stationary strips.

8. The method defined in claim 5, wherein said step of connecting said second and fourth switches to said second common actuator includes disposing a pair of spaced contacts on opposite sides of the center of rotation of a rotor and sliding said contacts over stationary strips.

9. A method of controlling high/low beam vehicle headlamps and fog lamps comprising:

(a) disposing a first and second contact strip in a substantially planar array and connecting said first strip to a high beam headlamp and said second strip to an on-board source of power;

(b) disposing a third contact strip in said array and connecting said third strip to said source of power;

(c) disposing a fourth strip in said array and connecting said strip to said low beam headlamp;

(d) disposing a fifth contact strip in said array and connecting said strip to said fog lamps;

(e) moving an actuator between a neutral and an actuated position and return to said neutral position and initially disconnecting said second strip from said first strip to and subsequently connecting said first strip from said third strip then subsequently disconnecting said fourth strip from said third strip; and, (f) latching said connecting of said first strip to said third strip and returning said actuator to said neutral position.

10. The method defined in claim 9, wherein said step of latching includes moving a bi-stable member.

11. The method defined in claim 9, wherein said step of moving an actuator includes providing a rotatable lever and profiling a cam on said lever and rotating said cam against said actuator.

* * * * *